US005993521A

United States Patent [19]

Loreth et al.

[11] Patent Number: 5,993,521

[45] Date of Patent: Nov. 30, 1999

[54] TWO-STAGE ELECTROSTATIC FILTER

[75] Inventors: Andrzej Loreth, Åkersberga; Vilmos Török, Lidingö, both of Sweden

[73] Assignee: TL-Vent AB, Lidingo, Sweden

[21] Appl. No.: 08/870,994

[22] Filed: Jun. 6, 1997

Related U.S. Application Data

[63] Continuation of application No. 08/290,878, filed as application No. PCT/SE93/00135, Feb. 19, 1993, abandoned.

[30] Foreign Application Priority Data

Feb. 20, 1992 [SE] Sweden ..... 9200515

[51] Int. Cl.[6] ..... B03C 3/08

[52] U.S. Cl. ..... 96/69; 96/79; 96/85; 96/98

[58] Field of Search ..... 96/69, 96, 77–79, 96/85–88, 98; 55/DIG. 38; 95/57, 79

[56] References Cited

U.S. PATENT DOCUMENTS

| | | | |
|---|---|---|---|
| 2,181,767 | 11/1939 | Penney | 96/79 |
| 2,875,845 | 3/1959 | Penney | 96/85 |
| 4,072,477 | 2/1978 | Hanson et al. | 55/DIG. 38 |
| 4,861,356 | 8/1989 | Penney | 96/77 |

FOREIGN PATENT DOCUMENTS

| | | | |
|---|---|---|---|
| 0332624 | 9/1989 | European Pat. Off. . | |
| 0332624 | 1/1992 | European Pat. Off. . | |
| 2854742 | 3/1986 | Germany . | |
| 50-60875 | 5/1975 | Japan . | |
| 931625 | 7/1963 | United Kingdom | 96/79 |
| 1082234 | 9/1967 | United Kingdom | 96/79 |
| 8805972 | 8/1988 | WIPO . | |

OTHER PUBLICATIONS

Mitsubishi Electric Corporation, drawings and specifications, Mar. 18, 1983.

"Electrostatiska Filter;" Industrifilter, Industriel Miljo, May 17, 1994.

"Air Filtration System—RC Type," Panasonic, Mar. 29, 1995.

*Primary Examiner*—Richard L. Chiesa

*Attorney, Agent, or Firm*—Browdy and Neimark

[57] ABSTRACT

A two-stage electrostatic filter includes an ionization section which is arranged in an upstream part of a throughflow passage (28) and includes a wire-like corona electrode (31) which is disposed in an ionization chamber (29) and connected to one pole of an electric high voltage source (16). The filter further includes a target electrode (21;37) which is spaced from the corona electrode (31) and connected to another pole of the high voltage source. A capacitator separator (30) is located in a downstream part of the throughflow passage (28) and includes a first and second group of electrode elements (32,33) which are placed side-by-side in spaced-apart relationship. The electrode elements (32) of the first group are placed alternately with the electrode elements (33) of the second group and are adapted to lie on a potential which is different from the potential on which the electrode elements (33) of the second group lie. The ionization chamber (29) has a target electrode surface (37;21) which is disposed both upstream and downstream of the corona electrode (31). When measured perpendicularly to the upstream-downstream direction of the throughflow passage (28) and to the longitudinal axis of the corona electrode, the distance of the corona electrode (31) from the target electrode surface is at least four times the distance between neighboring electrode elements (32,33). The capacitator separator (30) and the ionization chamber (29) form a disposable unit made of a non-metallic material, preferably a cellulose fibre material.

41 Claims, 3 Drawing Sheets

TWO-STAGE ELECTROSTATIC FILTER

This application is a continuation of application Ser. No. 08/290,878, filed on Aug. 19, 1994, now abandoned, which was a 371 of PCT application PCT/SE93/00135, filed Feb. 19, 1993.

BACKGROUND OF THE INVENTION

1. Field of Technology

The present invention relates to a two-stage electrostatic filter (electrostatic precipitator), and more specifically to a two-stage electrostatic filter.

2. Prior Art

Electrostatic filters, also called electrostatic dust separators, are used both in industrial production plants, in which case the electrostatic filters are in the form of large and expensive apparatus, and in apparatus in which air is cleansed for comfort purposes, such as air-conditioning apparatus and other apparatus for use in domestic dwellings, offices and other places of work, schools, hospital care facilities, motor vehicles and other places in which the air can be cleansed with comparatively much smaller apparatus.

In this latter case, in which it is mostly the air present in occupied places or the air entering such places that is to be cleansed, the filters used have hitherto essentially comprised mechanical filters provided with fibre filter cloths, textile or paper-based fibre-filter mats or electrode filter mats.

Electrostatic filters have also been used to a certain extent in this latter case. These electrostatic filters have normally been two-stage electrostatic filters by which is meant electrostatic filters in which the solid or liquid particles, aerosols, which are carried by the airflow and which are to be extracted therefrom are electrically charged in a separate ionization section while the actual separation process takes place in a capacitor separator positioned downstream of the ionization section. The present description is concerned with two-stage electrostatic filters, unless stated otherwise.

Mechanical air filters almost exclusively use disposable or exchangeable filter elements. Thus, those parts of the filter which primarily capture the separated material and which are therefore the filter components that are most subjected to dirt and clogging constitute units which can be readily exchanged. These elements, or units, are used until they can no longer fulfil their intended function in a satisfactory manner and are then replaced with a new unit and scrapped.

Hitherto, disposable units have not been used in electrostatic filters; at most, the capacitor separators typically comprised of aluminium plates and high-grade insulating material have been given the form of cassettes which can be removed readily from the filter apparatus for cleaning purposes. The task of cleaning these cassettes, however, is both time-consuming and expensive and can result in the spreading of unhealthy dust. Electrostatic filters are also expensive to run.

Because of these high running costs, electrostatic filters have not been used to an extent which corresponds to the important advantages that electrostatic filters afford over mechanical filters.

Another contributory cause lies in the fact that present-day electrostatic filters have a complicated and expensive construction due to the use of high voltages and the safety requirements associated therewith, such as the requirement of touch-safe designs and the use of high-grade materials, for instance for the insulators. A further contributory cause lies in the necessity of using high corona current intensities in order to avoid poor separation efficiency, which in turn results in a substantial generation of irritating odourants (ozone) in the chemically highly active plasma layer adjacent the corona electrode, or limits the cleansing capacity of the apparatus.

Furthermore, in conventional electrostatic filters, dust collected on the electrodes of the capacitor separator often causes sparkover between the electrodes, resulting in problems when using the filter in sensitive environments and danger of complete loss of the separating function.

Among the advantages which electrostatic filters afford in comparison with mechanical filters is that despite causing a very small pressure drop in the gas flow to be cleansed, electrostatic filters have the ability to separate extremely small particles from the gas flow; typical respirable particles have a diameter of about 0.3 $\mu$m. Mechanical filters always have a considerable pressure drop. In particular, in the case of filters that are constructed to separate respirable particles from the gas flow, the pressure drop across the actual filter part (the filter element) is extremely high. This high pressure drop necessitates the use of noisy and power-demanding fans for transporting the gas through the filter.

OBJECT OF THE INVENTION

The object of the present invention is to provide an improved electrostatic filter of the kind described in the introduction, and then more specifically to provide an electrostatic filter which is efficient and produces little ozone and can be manufactured simply and cheaply. Inclusion of a disposable unit of the filter parts which, of operation, become so dirty or are so affected in some other way as to require maintenance will thereby be economically justified. In this regard, the disposable unit is preferably designed so that it will not create a serious environmental problem when scrapped.

SUMMARY OF THE INVENTION

This object is achieved in accordance with the invention with an electrostatic filter having the characteristic features set forth below.

A particularly important aspect of the invention resides in the construction of the ionization section of the electrostatic filter. This construction not only enables the filter construction to be simplified to an extent such as to enable the main filter parts to be incorporated in an economic disposable unit, but also enables the electrostatic filter to be operated at a corona current intensity which is greatly reduced in relation to the corona current intensity required by known electrostatic filters of equivalent performances, thereby reducing the generation of ozone to a corresponding extent; the amount of ozone generated is proportional to the intensity of the corona current.

It is known that two charging mechanisms are to be found in a space-charge field, i.e. a field which exists between the corona electrode and the target electrode in the ionization section of an electrostatic filter. These two charging mechanisms are called respectively the field charging mechanism and the diffusion charging mechanism and are active within the critical particle range, 0.1–1 $\mu$m. Charging of the particles continues towards a final state with a time constant which is directly proportional to the ion-current density and inversely proportional to the electrical field strength at the particle.

In the ionization chamber of the ionization section, in which chamber the air ions are generated by a corona wire which has a given corona current intensity per unit of wire length, the electrical charge of the air ions has a dominating influence on the electrical conditions over the major portion of the volume of the ionization chamber. Ignoring an insignificant volume around the corona wire, the following factors apply across the volume of the ionization chamber:

The electrical field strength is practically independent of the distance from the corona wire;

The ion current density is inversely proportional to the distance from the corona wire.

The particle-charging time constant is therefore directly proportional to the distance from the corona wire.

When considering a particle which passes at a given velocity and at the greatest possible distance from the corona wire through a contemplated ionization chamber which has a square cross-section at right angles to the corona wire, it is found that both the particle-charging time constant and the particle residence time in the ionization chamber are proportional to the width of the ionization chamber, i.e. the dimension of the chamber at right angles to the corona wire and at right angles to the throughflow direction. The quotient between the particle residence time in the ionization chamber and the particle-charging time constant is therefore constant.

It therefore follows that at a given corona current intensity and a given airflow velocity, the charging state of the particle subsequent to its passage through the ionization chamber will not depend on the width of the chamber.

This novel realization leads to the conclusion that at a given corona current intensity and a given airflow velocity, it is possible to increase the width of the ionization chamber, and thereby also the volume rate of the air flow through the chamber, without impairing the charging of the aerosol particles carried by the airflow.

Although an increase in the width of the ionization chamber will also necessitate an increase in the corona-wire supply voltage, this necessary increase in supply voltage is less than proportional to the increase in the width of the ionization chamber. Consequently, a moderate increase in the supply voltage will enable the width of the ionization chamber to be greatly increased; the chamber can be given a width as large as 0.2 m or even larger, even in the case of electrostatic filters that are intended for home use or for use in hospital care facilities, etc., without it being necessary to increase the supply voltage to values that are considered unsuitably high for such use.

An ionization chamber width of the aforesaid magnitude is in the order of ten times the width of the ionization chamber used in conventional electrostatic filters that are intended for equvivalent use. The larger ionization chamber width characteristic of the present invention, therefore enables a radical reduction in corona current intensity to be achieved in comparison with standard or conventional electrostatic filters, while, at the same time, permitting an increase of the corona current intensity per unit of wire length, i.e. of the factor primarily decisive in the actual particle charging process.

In the case of an electrostatic filter constructed in accordance with the invention, the corona current intensity can be reduced by a factor of ten or more without needing to increase the voltage by more than that which can be readily achieved with present-day techniques in the field of small high-voltage sources.

The perimeter of the ionization chamber surrounding the corona wire is preferably covered to the greatest possible extent by a target electrode surface, so as to provide the largest possible ionizing zone. In this regard, it is particularly effective to place a part of the target electrode surface transversely across the airflow passage upstream of the corona electrode, so that a part of the ion flow will be directed straight opposite to the airflow direction. As a result, the aerosol particles will be retarded in relation to the airflow, so that their residence time in the ionization zone is extended. A long residence time is not only beneficial because a longer period of time then becomes available for the particle charging process, but also because the individual, electrically charged particles have time to coagulate and form larger particle aggregates within the ionization zone, thereby facilitating separation of the particles in the capacitor separator.

A target electrode element placed transversely across the air throughflow passage in the aforedescribed manner must, of course, allow the airflow to pass without undergoing an appreciable drop in pressure. This can be readily achieved within the scope of the invention, however, since the target electrode element may be comprised of a number of thin wires or filaments, a grid, lamellae or strips, a perforated plate or the like. The distance between the corona electrode and one such target electrode element will preferably be roughly the same as the distance between the corona electrode and a laterally placed target electrode element.

It is also possible within the scope of the present invention, albeit not preferred, to arrange two or more corona electrodes in side-by-side relationship as seen in the direction of air throughflow, for instance in a common plane which extends transversely to the air throughflow passage. In this case, it is necessary in practice to place a target electrode element transversely to the air throughflow passage in the aforesaid manner upstream of said wires, so as to ensure that the particles carried by the airflow will be sufficiently charged.

The reduction in corona current intensity enabled by the present invention does not only result in a reduction in the generation of troublesome ozone but also enables the high voltage source which supplies the corona electrode to be constructed so that the current delivered will be so weak as to render the system harmless to a human being.

To this end, passive current limiting elements of very high resistance values may be included in the corona current circuit, in accordance with the invention. The current limitation which in the event of a short circuit caused by touching the system is ensured in the aforesaid manner renders it unnecessary to touch-protect the corona electrode and other readily accessible parts of the electrostatic filter to which high voltages are applied. Furthermore, the risk of the ignition of inflammable dust or other material extracted in the electrostatic filter as a result of sparkover in the ionization chamber or in other locations in the electrostatic filter are eliminated in practice.

This enables the walls of the ionization chamber to be made of paperboard, cardboard, kraft paper or other inexpensive materials. The corona electrode insulators may be made of a simple plastic material, such as polyurethane for instance. The surfaces of the wall-forming parts will preferably be coated with or formed from an electrically conductive or semi-conductive material (antistatic or dissipative material). These surfaces may, at the same time, form the target electrode surface and surfaces for connecting the same and the outer surface of the ionization chamber to earth or to some other reference potential.

The above comments made with regard to the ionization chamber are also applicable to the capacitor separator.

In present-day electrostatic filters, all of the capacitor electrode elements that are intended to have the same voltage polarity are electrically connected in parallel; one group of electrode elements is connected in parallel to, for instance, earth potential, while the remaining capacitor electrode elements are connected in parallel to, for instance, a positive pole on the high-voltage source.

Consequently, should the material separated from the airflow collect to form a deposit which causes sparkover between two neighbouring electrode elements, the whole of the separation part of the filter will become totally ineffective. The voltage level must therefore have a low value which is chosen on the basis of the lowest expected electric strength of the capacitor separator, i.e. on the basis of its electrically weakest point, so that sparkover need not be feared.

According to one preferred embodiment of the invention, a group of the capacitor electrode elements are electrically insulated from one another and from the high voltage source. A voltage is applied to each of these electrode elements individually, by virtue of the fact that at least an electrode element portion facing the corona electrode extends into the ionization zone, thus in the upstream direction beyond those electrode elements that are connected to earth potential or a reference potential, whereby this group of electrode elements become charged electrically, although they have no galvanic connection with one another or with the high voltage source.

This individual voltage application eliminates the voltage limitation that must be undertaken in the case of known electrostatic filters, because of the fact that in them any local sparkover will make the entire capacitor separator inoperative. Instead, each electrode element to which a voltage is applied takes the highest voltage that it can accept and the capacitor separator will thereby always have the best possible efficiency.

The risk of sparkover from one of the electrode elements to which voltage is applied individually is eliminated, in accordance with a preferred feature of the invention, in that these electrode elements have field concentrating formations. A weak secondary corona discharge begins from these formations when the voltage difference between one such electrode element and a neighbouring electrode element tends to become too high. The voltage difference is thereby automatically limited to a value which is insufficient for sparkover to take place.

The high-resistive character of the discharge and the low corona current intensity renders the electrically charged electrode elements quite safe to touch. Anyone that comes into contact with the electrically charged electrode elements may be totally unaware of the fact, since the sensitivity threshold value of human beings to current passing through the body is about 100 $\mu$A and because the current intensity can be readily limited to a value beneath this threshold value when practicing the invention. Consequently, the capacitor separator need not be provided with a touch-guard to eliminate the risk of unpleasantness or danger in the event of touching the capacitor separator, and if a touch guard is nevertheless provided for other reasons, it need not be made of a strong material.

In order that the concept of individually applying a voltage to the electrode elements may be realised with the best results in practice, the voltage of the corona electrode should be much higher (2–3 times as high) than the voltage to which it is desirable to charge the individual electrode elements of the capacitor separator. This requirement, however, can be readily satisfied with the inventive electrostatic filter, since in view of the wide ionization chamber it is, in all events, suitable for the voltage on the corona wires to be relatively high, and since the requisite voltage can be readily obtained and does not involve any increased risk.

As will be evident from the foregoing, the electrode elements of the capacitor separator may be made of an inexpensive material, for instance paperboard or some other cellulose fibre material of intrinsically sufficient conductivity, or of a material which can be given a sufficiently high conductivity by coating or impregnating it with a suitable substance (so-called dissipative or antistatic materials).

When material of the aforesaid kind is used, the above-mentioned field concentrating formations can be obtained without needing to take separate measures. The sharp edges that plates or sheets of such material normally obtain when cut, for instance punched from larger sheets, by themselves form such formations. Naturally, if so desired, pointed tongues or the like can be formed at suitable locations on the electrode elements so as to provide field concentrating formations.

The ionization chamber, the corona electrode and the capacitor separator may advantageously be combined to form a single disposable unit. This unit can be included in a sterilized package if so required, for instance when it is to be used in a hospital environment.

If the disposable unit is used in environments which are liable to contaminate the unit with airborne pathogenic organisms, it may be necessary, or appropriate, to replace the disposable unit with a fresh unit before the unit becomes so contaminated with material separated from the airflow as to necessitate changing of the unit under all circumstances. Before being removed from the filter apparatus, the used disposable unit can be sealed-off so as to reduce the risk of spreading the pathogenic organisms.

Since disposable material, i.e. material which need not be cleaned or reconditioned, can also be used for the insulators of the electrode elements of the capacitor separator, the distance between the plates can be reduced in comparison with known electrostatic filters. Cleaning or reconditioning requires a greater distance between the plates than that required when no cleaning or reconditioning is necessary. As is known, a smaller distance between the electrode elements renders the separator more effective.

The improved efficiency achieved by reducing the distance between the electrode elements can be utilized to reduce the volume of the capacitor separator. This possibility to reduce separator volume is particularly significant in applications where a small space requirement for the electrostatic filter is important or decisive for the usefulness of the filter. This is the case, for instance, in car air-purifying systems, vacuum cleaner output air-purifiers, etc. In cases such as these, the electrostatic filter can be used together with a mechanical coarse filter which functions to extract larger particles before they reach the electrostatic filter, so that the electrostatic filter will only be subjected to the finer particles which are often most hazardous to the health and which at present cannot be removed by mechanical filters in the aforesaid applications.

When a separate fan is used to transport air through the electrostatic filter, this fan may be a relatively slow fan while still producing the desired airflow with a very low pressure drop, owing to the wide air-throughflow cross-section made possible by the wide ionisation chamber. Consequently, the fan may be driven by a small and inexpensive electric motor, e.g. a multi-pole permanently magnetized synchronized motor of simple design. A slipping clutch may be mounted between the motor shaft and the fan rotor so as to enable self-starting of the motor.

BRIEF DESCRIPTION OF THE DRAWINGS

Exemplifying embodiments of the electrostatic filter according to the invention will now be described in more detail with reference to the accompanying drawings, in which.

DETAILED DESCRIPTION OF THE PREFERRED EMBODIMENT(S) OF THE INVENTION

Figure 1:
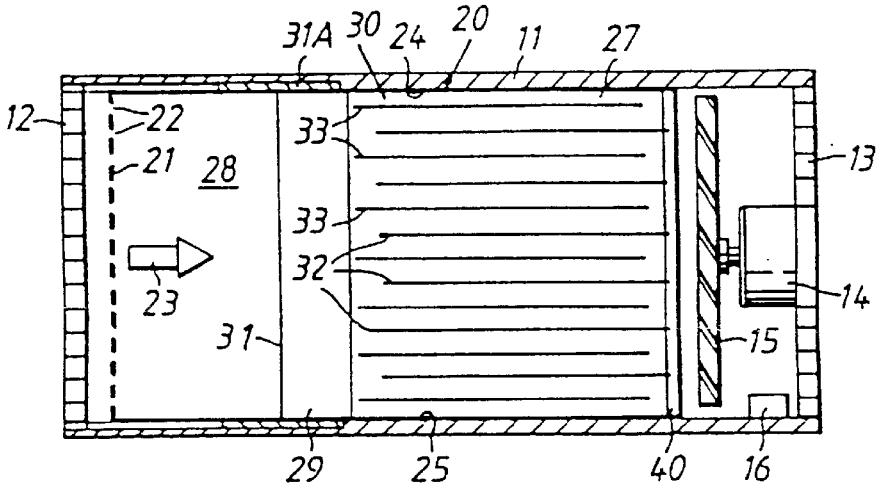
FIG. 1 is a schematic sectional view of the electrostatic filter, taken in the throughflow direction.

The inventive electrostatic filter illustrated by way of example in FIG. 1 includes an outer casing 11, which has the form of a tube of rectangular cross-section and includes an air inlet opening 12 and an air outlet opening 13. The casing houses a fan 15 which is driven by an electric motor 14, and associated connecting and operating means which are represented symbolically by a block 16 which also includes the high voltage unit of the electrostatic filter. The electric motor 14 is preferably a multi-pole permanently magnetized synchronous motor whose rotor is drivingly connected to the fan rotor through the agency of a slipping clutch.

The casing 11 also houses the aforesaid disposable unit, identified generally by reference numeral 20 and emphasized with heavy contour lines. This disposable unit can be inserted into and withdrawn from the casing through its air inlet end or may be placed into and removed from the casing through one of its side-walls. The disposable unit 20 is held in place in the casing with the aid of appropriate retaining devices, not shown.

All of the aforesaid parts of the electrostatic filter may be constructed in accordance with known techniques, with the exception of the disposable unit 20, and consequently such parts will not be described in detail here. In addition to the parts already mentioned, the electrostatic filter may also include other components, for instance pre-filters, air guiding elements, etc. However, such components may be of a conventional kind and do not form any part of the invention and have consequently been omitted from the drawings.

The disposable unit 20 essentially has the form of a box which is open on one side thereof, namely the side which is adjacent the fan 15 and the air outlet opening 13 of the casing. On the opposite side of the box, namely the side facing the air inlet opening 12 of the casing 11, there is mounted a front wall 21 which extends throughout the entire height and width of the casing and which is perforated essentially over the whole of its surface area with relatively large and closely spaced perforations 22. The airflow generated by the fan 15 and marked with an arrow 23 in FIG. 1 is therefore able to enter the airflow passage 28 defined by the sidewalls 24, 25, 26 and 27 of the disposable unit without meeting any great resistance.

The section of the air throughflow passage 28 that is located adjacent the inlet end or upstream end of the unit forms an ionization chamber 29. This chamber is delimited in the upstream direction, i.e. forwardly, by the inner surface of the front wall 21, and in the downstream direction, or rearwardly, by the capacitor separator, generally referenced 30. The ionization chamber 29 is delimited laterally by a pair of wall-members 37 which are positioned inwardly of the front sections 26A and 27A of the side-walls 26 and 27 and which will be described in more detail below.

In the case of the illustrated orientation of the electrostatic filter, the aforesaid walls are vertical and, for the sake of simplicity, will also be considered vertical in the following, although it will be understood that when the electrostatic filter is positioned differently than shown, these side-walls may extend horizontally for instance. Accordingly, other parts of the electrostatic filter, e.g. the aforesaid wall-members which extend vertically in the illustrated position of the electrostatic filter, will also be referred to as vertical while parts which are shown to be horizontal, e.g. the walls 24 and 25, will be referred to as horizontal parts.

A corona electrode 31 in the form of a thin metal wire extends vertically through the ionization chamber 29, between the vertical walls 26 and 27 and between the front wall 21 and the capacitor separator 30. The corona electrode wire is stretched between insulators 31A on the horizontal walls 24 and 25 and is connected in a manner not shown in detail to the high voltage unit in block 16 when the disposable unit 20 is seated in position in the casing 11. When the electrostatic filter is in operation, the high voltage unit holds the corona electrode 31 on a voltage in relation to earth or some other reference potential sufficient to create a corona discharge, preferably a voltage of at least +10 kV.

The capacitor separator 30 is comprised essentially of two arrays of electrode elements in the form of rectangular lamellae or plates. One electrode element array is referenced 32 and forms a first electrode which is connected to earth or to a reference potential. The second array of electrode elements is referenced 33 and forms a second electrode. As described in more detail below, during operation this electrode is maintained at a potential relative to the potential of the electrode elements 32 which is considerably lower than the potential of the corona electrode, e.g. at a potential which is between one-third and one-half of the corona electrode potential.

The electrode elements 32 and 33 extend across the whole of the interspace between the vertical walls 26 and 27 and are arranged one over the other in horizontal positions so as to form a stack with the electrode elements 32 placed alternately with, and vertically spaced from, the electrode elements 33. Thus, the electrode elements form a plurality of broad and low, parallel sub-passages 28A which together form that section of the throughflow passage 28 in the disposable unit 20 which is occupied by the capacitor separator 30.

As will be seen from FIG. 1, the electrode elements 33 of the second separator electrode are displaced slightly in the upstream direction of the air throughflow passage 28 in relation to the electrode elements 32 of the first separator electrode, so that the upstream end of the electrode elements 33 is slightly closer, e.g. 5–10 mm closer to the corona electrode 31 than the upstream ends or front edges of the electrode elements 32. The same applies to the downstream ends or rear edges of the electrode elements.

It will also be seen from FIG. 1 that all electrode elements 33 are equidistant from the corona electrode 31.

The vertical walls 26 and 27 of the disposable unit 20 include an inner plate 26B and 27B, respectively, made from an electrically insulating material preferably from expanded plastic, e.g. expanded polystyrene (for instance Styropore®). The inside of each inner plate is provided for each electrode element 32, 33 with a shallow, longitudinally extending groove 34 and 35 respectively, which is open towards the downstream edge of the plate and extends in the upstream direction to a position in which the upstream edge of the electrode element shall be positioned. The electrode elements are held securely with their side-edges located in the grooves 34, 35. Despite the electrode elements being secured in the upstream-downstream direction solely by friction, they are nevertheless secured fully satisfactory, since the electrode elements are not subjected in use to forces that tend to displace them.

The inner plates 26B and 27B function to impart good stability to the disposable unit and to hold the electrode elements 32 and 33 in position, and thereby also to insulate the electrode elements 33 electrically one from the other and from the side-walls 26 and 27 and from the electrode elements 32. In an alternative embodiment (not shown), the inner plates are replaced with separate holders for the electrode elements 33. These separate holders have the form of small blocks, mounted on the inside of the side-walls 26, 27 and provided with recesses into which the electrode elements can be readily placed and fixed in a given position. The electrode elements 32 of this alternative embodiment are seated directly against the side-walls.

As will be evident from the foregoing, there is no electrically conductive or galvanic connection between the electrode elements 33 themselves or with other parts of the electrostatic filter. The purpose of this arrangement will be evident from the following.

The edges of the electrode elements 32 of the first separator electrode, which elements also include an electrically conductive surface and project beyond the electrode elements 33 in the downstream direction, have an electrically conductive connection with one another through the agency of an electrically conductive strip of a suitable rubber or plastic material, for instance an antistatic material. This strip, indicated at 40 in FIG. 1, is placed in electrical connection with an earth or reference potential terminal (not shown) when the disposable unit 20 is inserted in the casing 11.

In the illustrated and described embodiment of the disposable unit 20, the electrode elements 32 and 33 are preferably comprised of paperboard, for instance corrugated paperboard, which may be coated on one or both sides thereof with an electrically conductive layer, for instance a layer of electrically conductive paint sprayed onto the paperboard or applied thereto in some other way. Such a coating is not always necessary; certain types of paperboard and similar materials function very well without any special treatment aiming at increasing the conductivity.

No high demands are placed on the electric conductivity of the electrode elements 32, 33 or their respective surfaces. The only requirement is that the electrode elements can be charged fairly easily to the desired potential. Accordingly, semi-conductive electrode elements or semi-conductive surface layers on the electrode elements can also be considered to be electrically conductive in the present context. The electrode elements or their respective surface coatings may conveniently comprise an antistatic or so-called dissipative material, by which is meant a material having a surface resistivity of $10^9$–$10^{15}$ ohms.

For reasons which will be evident from the following, it is suitable, in accordance with one characteristic feature of the invention, that the electrode elements include field concentrating formations. When the electrode elements are made of paperboard, these formations can be obtained without needing to take separate technical measures, namely as a result of cutting-out the electrode elements. The sharp edges that are formed when cutting-out the electrode elements are able to function as field concentrating formations. Naturally, it is also possible to produce such formations by cutting-out or punching-out pointed configurations or the like from the electrode element plates.

The ionization section of the disposable unit 20 includes the ionization chamber 29, the corona electrode 31 and the electrode means functioning as target electrodes for the corona electrode. The ionization section also includes a second target electrode element which is formed by the air permeable front wall 21 of the disposable unit (the first target electrode element is formed by the parts of the electrode elements 33 that lie nearest the corona electrode). To this end, the front wall is provided on at least its inner surface with a surface layer which is electrically conductive in the aforesaid meaning of the term electrically conductive. The front wall 21 may be a separate wall element or may form an integral part of the horizontal walls 24, 25 of the disposable unit 20 and, similar to these walls, may conveniently be made of the same material as the electrode elements 32 and 33. The remaining parts of the side walls of the disposable unit 20 may also be made of a similar material.

Figure 2:
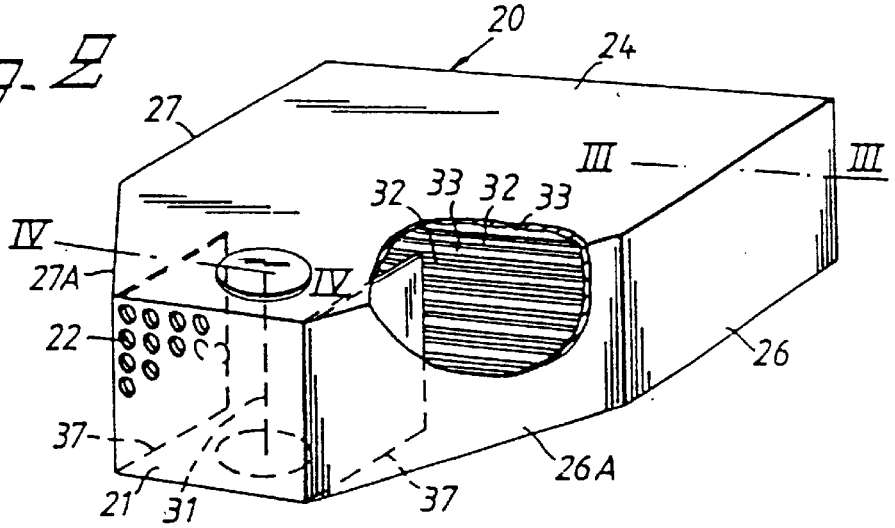
FIG. 2 is a perspective view of a readily exchanged, disposable part of the electrostatic filter shown in FIG. 1, this unit including the ionization section and capacitor separator of the electrostatic filter.
Figure 3:
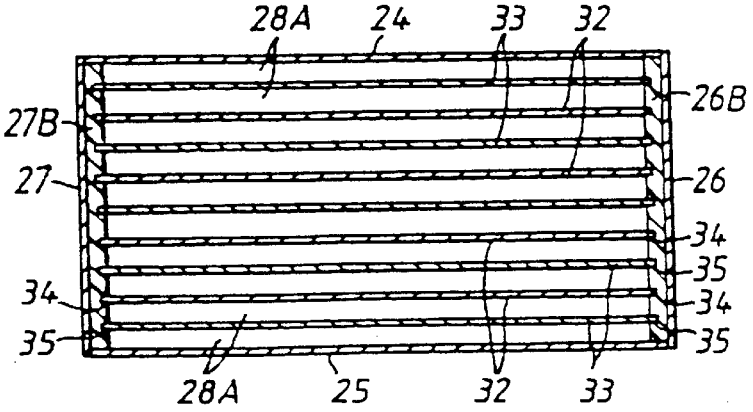
FIG. 3 is a cross-sectional view of the disposable unit, taken on the line III—III in FIG. 2.
Figure 4:
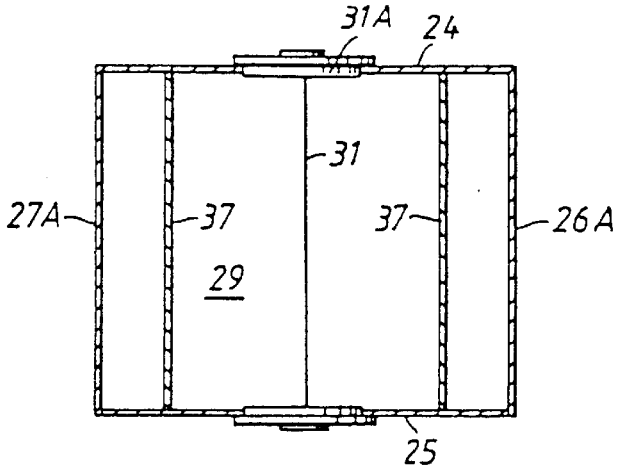
FIG. 4 is a sectional view of the disposable unit taken on the line IV—IV in FIG. 2.

As is apparent from FIG. 2, when seen from above, the front part of the disposable unit 20 accommodating the ionization chamber 29 has the form of an isosceles trapezoid whose shortest parallel side faces forwards and is formed by said front wall, whereas the rear part, which accommodates the capacitor separator 30 and connects with the longest parallel side of the trapezoid, has a parallelepipedic shape and the same height as the front part.

As a result of the trapezoidal shape of the front part of the disposable unit 20, the front part widens the space defined by the vertical side-wall sections 26A and 27A of said front part and the front portion of the horizontal side-walls 24, 25 of the disposable unit, from the front wall 21 to the position at which the ionization chamber 29 adjoins the capacitor separator 30.

However, the air throughflow passage 28 is delimited laterally at the front part of the ionization chamber 29 by a pair of parallel, vertical wall members 37, each extending rearwardly from a respective one of the vertical side edges of the front wall 21, roughly to a position abreast of the corona electrode 31 or to a position slightly beyond the corona electrode in the downstream direction. Consequently, the air throughflow passage has a generally constant cross-sectional area up to the location of the rear edge of the wall members 37, while the airflow is able to spread over a larger cross-sectional area throughout the remaining part of the flow path up to the location of the capacitor separator 30, where the throughflow cross-sectional area again becomes constant and considerably greater than between the wall members 37.

The portions of the wall members 37 lying closest to the capacitor separator are conveniently perforated (not shown) so as to facilitate the spreading of the airflow.

The wall members 37 are suitably comprised of the same material as the other walls of the disposable unit and also function as target electrodes for the corona electrode 31, which consequently has target electrode surfaces which extend throughout the height of the ionization chamber 29 and are positioned at the front, at the rear and on both sides. The target electrode surfaces formed by the wall members 37 are located approximately equidistant from the corona electrode 31, although at a slightly greater distance from said electrode than the front edges of the electrode elements 33.

Preferably, all parts of the disposable unit 20, with the exception of the corona electrode 31 and associated insulators and electrode elements 33, lie on the earth potential or on a reference potential, since they are electrically connected with one another and with the strip 40 and consist of or are coated with a conductive material.

When the electrostatic filter is in operation, the airflow generated by the fan 15 enters the ionization chamber 29 of the disposable unit 20 through the perforations 22 in the front wall. The particles carried by the airflow are subjected in the ionization chamber to the ion current which flows between the corona electrode 31 and the electrode elements that function as target electrodes for the corona electrode, namely the front wall 21, the wall members 37 and those parts of the electrode elements 33 which are closest to the corona electrode.

As a result of this arrangement with target electrode elements located upstream, downstream and laterally of the corona electrode 31 and at a distance therefrom which is relatively long in comparison with known electrostatic filters, the particles carried by the airflow will have a long residence time in the ion current, which fills essentially the whole of the ionization chamber. This results in two effects that are favourable to the efficiency of the separation.

Firstly, the airborne particles are charged to a maximum during their travel to the capacitor separator 30, and secondly the particles have time to agglomerate during their passage to the capacitor separator. Both of these circumstances render the separation in the capacitor separator 30 more effective.

When the charged particles arrive in the passages 28A between the electrode elements 32, 33 of the capacitor separator 30, the particles are moved towards the electrode elements 32 in a well-known manner, namely under the influence of the electric field that extends transversely across the passages, and are precipitated on the electrode elements. The electric field exists because the electrode elements 33 lie on a potential which is higher than the potential (the earth potential or the reference potential) on which the electrode elements 32 lie. Charging of the electrode elements 33 to this potential is due to the charge transportation to these electrode elements 33 that takes place through the ion current passing from the corona electrode 31 to the front edges of the electrode elements 33 projecting into the ionization chamber 29.

The potential on which the electrode elements 33 lie depends on the magnitude of the distance from the corona electrode 31 to the nearest place on the front edge of the electrode elements 33. This distance is preferably chosen so that the potential in relation to the earth or reference potential will be between a third and a half of the potential of the corona electrode 31 in relation to the earth or reference potential.

Since the electrode elements 33 are electrically insulated from one another, the elements are charged independently of one another. Thus, if sparkover should occur between one electrode element 33 and a neighbouring electrode element 32 (such sparkover can occur as a result of dirt collecting on the electrode element 33) and thereby cause the electrode element to discharge, the remaining electrode elements 33 will not be affected. Consequently, in the event of sparkover it is only the electrode element 33 on which sparkover occurs whose action is impaired, because the potential of this element shifts to a slightly lower level as a result of electrical charge leaking over to the neighbouring electrode element 32.

Since the consequences of a "short circuit" are not serious, due to the individual charging of the electrode elements 33 and to their relatively low conductivity, the distance between neighbouring electrode elements 32 and 33, i.e. the width of the passages 28A, can be made smaller than would otherwise be possible if all of the electrode elements 33 were interconnected galvanically. A reduced distance is advantageous, because the average distance that the particles need to travel sideways, i.e. transversely to the electrode elements, in order to reach the precipitation electrode elements 32 then becomes shorter. Such a shortening of the sideways travel in turn permits a shortening of the passages 28A between the electrode elements 32, 33 in the direction of flow, or alternatively results in a more complete dust separation process with unchanged length of the passages.

The electrode elements 32, 33 of the capacitor separator 30 and any other parts with which the airflow comes into contact in its passage from the ionization chamber 29 may advantageously be made of or coated with a readily oxidized material. This enables the ozone that is unavoidably generated in the vicinity of the corona electrode 31 to be readily eliminated before leaving the disposable element 20.

It will also be noted that the amount of ozone generated in the inventive electrostatic filter is small in comparison with the amount that is generated in known electrostatic filters. The reason for this is that the electrostatic filter according to the invention can be operated with a weak corona current, lower than 100 $\mu$A, partly because the configuration of the ionization section results in effective charging of the particles, and partly because the passages between the electrode elements of the capacitor separator can be made narrow.

The weak corona current has another effect which is favourable to the simplicity of the disposable unit because the high voltage unit can be caused to produce such a low current as to make the high voltage part touch-safe. Consequently, it is not necessary to provide the disposable unit with a touch guard for the electrically active parts for safety reasons, and if a touch guard is nevertheless provided it need not be made of very strong material. The short circuiting current through the corona electrode can be readily limited to a value which is acceptable from the safety aspect, e.g. 750 $\mu$A, with resistors having a high resistance (in the megohm range).

The embodiment illustrated in FIGS. 1–4 comprises one single wire-like corona electrode 31 for all pairs of electrode elements 32, 33 in the capacitor separator 30, this said corona electrode extending perpendicularly to the planes that contain the electrode elements. Because the passages 28A extending between the electrode elements may have a very small height, i.e. dimension in the longitudinal direction of the corona electrode, the stack of electrode elements may include a large number of passages for a given length of the corona electrode.

One circumstance which together with the narrow passages 28A contributes to the high separating efficiency of the inventive electrostatic filter at a very small corona current resides in the configuration of the ionization section, more specifically the provision of target electrodes both upstream and downstream of the corona electrode and preferably also on the sides of the ionization chamber, such that the corona electrode has target electrode surfaces over a large part of the perimeter of the ionization chamber and at a relatively large distance from the corona electrode. This distance is preferably at least several times the distance between neighbouring separator electrode elements 32, 33 and is preferably not less than three and preferably not more than five or six times the distance between neighbouring electrode elements, and is suitably not less than about 4 cm.

Figure 5:
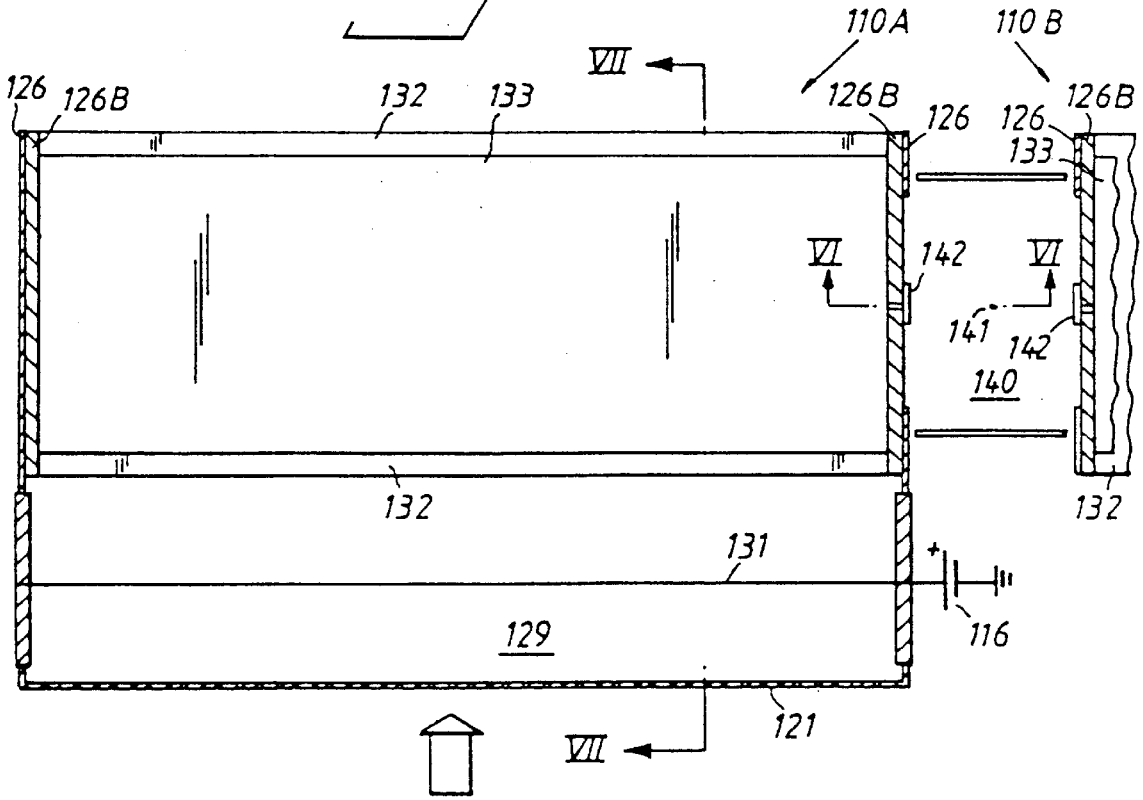
FIG. 5 is a sectional view of a further embodiment taken in a plane parallel with the electrode elements in the capacitor separator.
Figure 6:
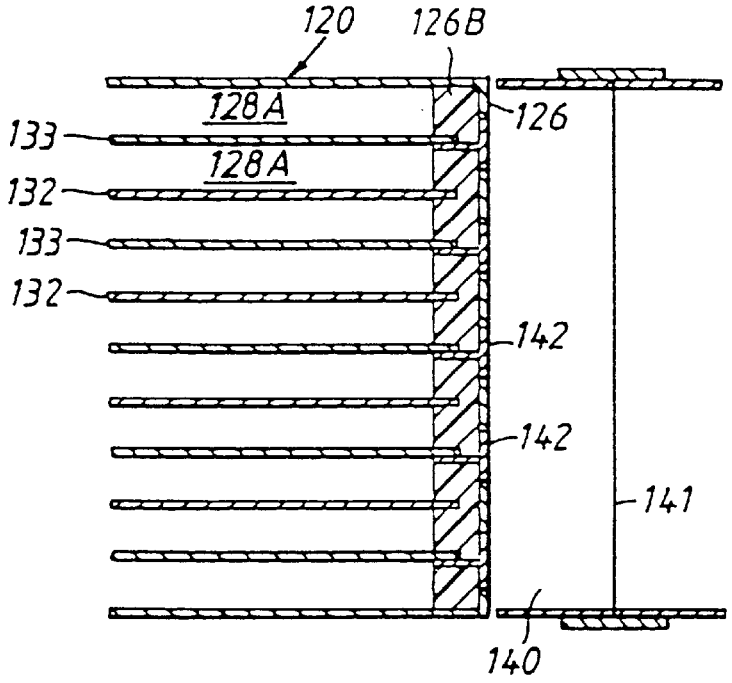
FIGS. 6 and 7 are views taken on the line VI—VI and line VII—VII, respectively, in FIG. 5.
Figure 7:
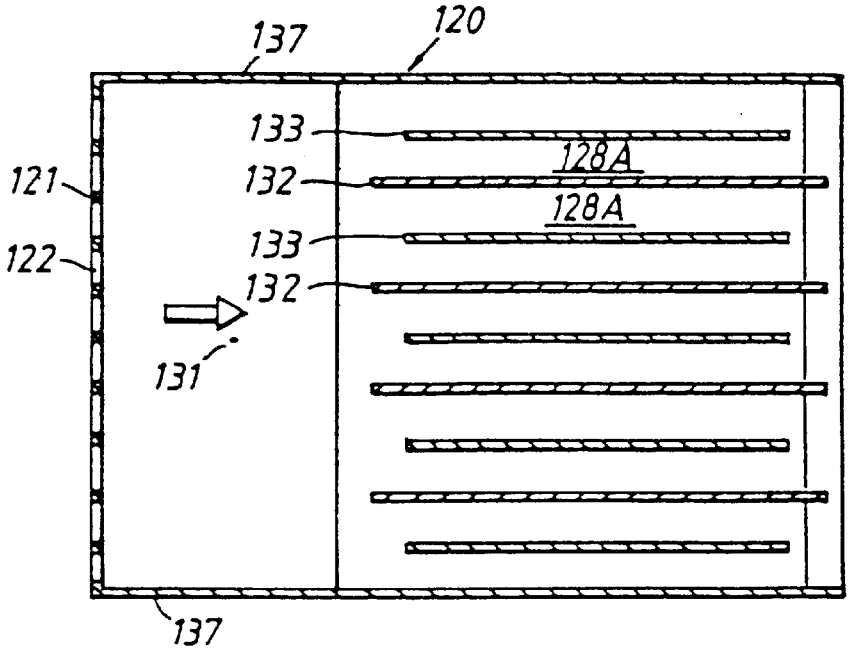

Those components illustrated in FIGS. 5–7 whose functions correspond to the functions of the components illustrated in FIGS. 1–4 have been identified with the reference numerals of the last-mentioned figures preceded by the numeral 1.

The embodiment illustrated in FIGS. 5–7 differs from the embodiment illustrated in FIGS. 1–4 in mainly two respects.

Firstly, a separate ionization chamber 140 is provided for charging these electrode elements 133 which shall have a higher potential than the electrode elements 132 that are connected to the earth or reference potential. As indicated in FIG. 6, this ionization chamber 140, which is separated from the flow passage for air to be cleaned, may be common to two essentially similar sections 110A and 110B of the electrostatic filter.

Secondly, the wire-like corona electrode 131 is arranged in a plane which is generally parallel to the planes in which the electrode elements 132 and 133 lie. However, as in the foregoing embodiment, the corona electrode is common to all pairs of neighbouring electrode elements 132, 133, i.e. to all passages 128A between the electrode elements.

Because the air to be cleaned is not intended to flow through the ionization chamber 140, this ionization chamber may be made air-tight or essentially air-tight. The ionization chamber 140 accommodates a wire-like corona electrode 141 which is common to all electrode elements 133. The corona electrode may be connected to the high voltage unit so as to lie on the same potential as the corona electrode 131, although it may alternatively lie on a higher potential. Although the increase in ozone generation that results from a higher potential is undesirable, it is not particularly troublesome with regard to the ionization chamber 140, since the ozone will not accompany the air transported through the electrostatic filter.

As a target electrode for the corona electrode 141, there is provided for each electrode element in each of the filter sections 110A, 110B an electrically conductive contact member 142 which is mounted on the neighbouring outer side of the side-wall 126B of the disposable unit 120 and which is in conductive contact with the associated electrode element 133 through the side wall 126B.

Since the electrode elements 133 in the capacitor separator 130 are not in this case charged from the corona electrode 131 that is responsible for charging the particles, but from the further corona electrode 141, the electrode elements 133 are not displaced forwardly towards the corona electrode 131 as in the preceding embodiment, but are instead withdrawn in the downstream direction in relation to the electrode elements 132 connected to the earth or reference potential.

The electrode elements 133 are thereby screened from the ion current emanating from the corona electrode 131 by the electrode elements 132, the front edges of which suitably lie at roughly the same distance from the corona electrode 131 as the perforated front wall 121. The electrode elements 132 and the front wall 121 function as target electrode elements for the corona electrode 121. This also applies to the horizontal wall members 137, which limit the ionization chamber 129 upwardly and downwardly.

The embodiment illustrated in FIGS. 5–7 is best suited for electrostatic filters which comprise a relatively small number of electrode element pairs or passages in the capacitor separator.

In a modification (not shown) of the electrostatic filter of FIGS. 5–7 the separate ionization chamber 140 forms part of the throughflow passage for the air to be cleaned and is disposed adjacent the capacitor separator 130 at the downstream end of the passage.

As is best evident from the foregoing, the present invention enables a disposable unit comprising the ionization section and the capacitor separator to be constructed from a few simple, inexpensive and readily assembled components which can be scrapped after use without serious consequences to the environment. If the disposable unit is to be used in an electrostatic filter which is intended for use in an environment which must be protected against infection, the disposable unit can be readily sterilized or disinfected and enclosed in a sterilized package, so that the disposable unit will be free from pathogenic organisms when the package is opened and the disposable unit is inserted in the casing of the electrostatic filter.

The simplification of the electrostatic filter achieved with the present invention is not, however, restricted to the disposable unit. The reduced corona current that can be achieved with a disposable unit constructed in accordance with the invention also enables the high voltage unit to be simplified and produced more cheaply.

Although in the illustrated embodiments the corona electrode 31, 131 is incorporated in the disposable unit 20, 120, it is possible within the scope of the invention to exclude it from the disposable unit and arrange it for permanent use, e.g. by attaching it to the filter casing 11.

The inventive electrostatic filter and its disposable unit can be used for gas or air purification purposes in widely separate fields, both in those cases where small dimensions are required and the volume of gas flowing through the filter per unit of time is relatively small, and in those cases where very large volumes of gas or air are to be cleaned and the dimensions need to be correspondingly large. The former case will include purification of the exhaust air of vacuum cleaners, air purification in motor vehicles and in the supply air terminal devices of room ventilation systems and also in smaller air-conditioners used with such systems.

Examples of cases in which there is a need to purify larger volumes of air include central air processing or conditioning units for large ventilation systems, factory and workshop localities, indoor sports arenas and exhibition halls, etc.

The simple and inexpensive construction of the disposable unit also enables outdoor air to be cleaned at reasonable costs in particularly contaminated places, for instance heavily trafficated and confined places or other places that are subjected to heavily contaminated air.

In the aforedescribed exemplifying embodiments of the invention, the electrostatic filter is provided with its own fan which is responsible for the transportation of air through the filter. However, it is possible in many instances to avoid the use of a separate device for transporting air through the electrostatic filter, since the pressure difference across the filter which is required for transporting the air through the filter is very small in comparison with mechanical filters, can be obtained without being generated in the actual filter itself or in direct connection with the filter. Examples of such cases include electrostatic filters for supply air terminal devices of ventilation systems, or for vacuum cleaners, etc.

In order for the inventive electrostatic filter to fulfil its intended function, it is only necessary to apply across the unit consisting of the ionization section and the capacitor separator a pressure drop which is sufficient to transport the air through the filter.

When the electrostatic filter is used for separating high-resistive dust from the airflow, the surfaces of the ionization chamber may become covered with an insulating dust layer which is charged electrically and thereby reduces the corona current in the ionization chamber. This undesired phenomenon can be eliminated by fitting the ionization chamber with movable, e.g. web-like or band-shaped walls and with scrapers or other means which remove the dust layer from portions of the moving walls which are outside the ion current. Alternatively, the dust-laden surfaces of an ionization chamber having stationary walls may be cleaned during operation of the filter by means of reciprocable scrapers operating inside the ionization chamber.

We claim:

1. A two-stage electrostatic filter comprising an ionization section which is disposed in an upstream part of a throughflow passage and includes an ionization chamber in which there is mounted at least one elongated wire corona electrode which is connected to one pole of the electrical high voltage source, and a target electrode which is spaced from the corona electrode and connected to another pole of the high voltage source, a capacitor separator which is located in a downstream part of the throughflow passage and includes a first group and a second group of electrode elements which are arranged side-by-side in spaced-apart relationship, the electrode elements of the first group being disposed alternatively with the electrode elements of said second group and are on a different potential than the electrode elements of said second group, wherein, the electrode elements (32, 33; 132, 133) comprise an antistatic material having a surface resistivity of $10_9$–$10_{15}$ ohms, the ionization chamber (29, 129) includes a target electrode surface (37, 137; 21, 121; 132, 133) which is disposed both upstream and downstream of the corona electrode (31, 131); a distance of the corona electrode (31, 131) from the target electrode surface, when measured perpendicularly to the upstream and downstream direction of the throughflow passage (28, 128) and the longitudinal direction of the corona electrode being not less than about 4 cm and at least four times the distance between neighbouring electrode elements (32, 33; 132, 133).

2. An electrostatic filter according to claim 1, wherein the antistatic material is on a coating of the electrode elements.

3. An electrostatic filter according to claim 1, wherein the neighbouring electrode elements are adjacent to each other.

4. An electrostatic filter according to claim 1, wherein the electrode elements (32, 33; 132, 133) comprise an antistatic material having a surface resistivity of $10^{13}$–$10^{15}$ ohms.

5. An electrostatic filter according to claim 1, wherein the electrode elements (32, 33; 132, 133) comprise a dissipative material having a surface resistivity of $10^{13}$–$10^{15}$ ohms.

6. An electrostatic filter according to claim 1, wherein a part of the target electrode surface is formed by target electrode elements (37, 137) which are disposed on opposite sides of the corona electrode (31, 131) and which form opposing side-walls of the upstream part of the throughflow passage (28, 128).

7. An electrostatic filter according to claim 6, wherein a part of the target electrode surface is formed by a target electrode element (33, 132) which is arranged transversely across the throughflow passage downstream of the corona electrode (31, 131).

8. An electrostatic filter according to claim 6, wherein the electrode elements (32, 33; 132. 133) of the capacitor separator (30, 130) are essentially formed from a non-metallic material.

9. An electrostatic filter according to claim 8, wherein the non-metallic material is cellulose fibre material.

10. An electrostatic filter according to claim 8, wherein the non-metallic material is paperboard.

11. An electrostatic filter according to claim 8, wherein the non-metallic material is kraft paper.

12. An electrostatic filter according to claim 1, wherein a part of the target electrode surface is formed by a target electrode element (21, 121) which is arranged transversely across the throughflow passage (28, 128) upstream of the corona electrode (31, 131) and has air throughflow openings (22, 122).

13. An electrostatic filter according to claim 1, wherein a part of the target electrode surface is formed by a target electrode element (33, 132) which is arranged transversely across the throughflow passage downstream of the corona electrode (31, 131).

14. An electrostatic filter according to claim 13, wherein at least a part of the target electrode element extending transversely across the throughflow passage (28, 128) downstream of the corona electrode is formed by electrode elements (33, 132) of the capacitor separator (30, 130).

15. An electrostatic filter according to claim 14, wherein the electrode elements (32) of the first group are connected to a reference potential, the electrode elements (33) of the second group are electrically insulated from one another and from the electrode elements of the first group and lie at a shorter distance from the corona electrode (31) than the electrode elements of the first group; and the electrode elements of said second group extend so close to the corona electrode as to be charged to a potential in relation to the electrode elements of the first group which lies between the reference potential and the potential of the corona electrode to be not higher than about half of the potential of the corona electrode.

16. An electrostatic filter according to claim 15, wherein the reference potential is earth.

17. An electrostatic filter according to claim 1, wherein the electrode elements (32, 33; 132, 133) of the capacitor separator (30, 130) are essentially formed from a non-metallic material.

18. An electrostatic filter according to claim 17, wherein the electrode elements (32, 33; 132, 133) are coated with an antistatic material.

19. An electrostatic filter according to claim 17, where in the non-metallic material is a cellulose fibre material.

20. An electrostatic filter according to claim 17, wherein the non-metallic material is paperboard.

21. An electrostatic filter according to claim 17, wherein the non-metallic material is kraft paper.

22. An electrostatic filter according to claim 17, wherein the electrode elements (32, 33; 132, 133) are coated with an electrically conductive material.

23. An electrostatic filter according to claim 17, wherein the electrode elements (32, 33; 132, 133) are coated with a semi-conductive material.

24. An electrostatic filter according to claim 17, wherein the electrode elements (32, 33; 132, 133) of the capacitor separator (30, 130) are included in a part (20, 120) of the electrostatic filter which has the form of a disposable unit.

25. An electrostatic filter according to claim 24, wherein the disposable unit includes a housing (20, 120) which forms said throughflow passage and which is essentially comprised of a non-metallic material.

26. An electrostatic filter according to claim 25, wherein at least a part of the outside and inside of the housing (20, 120) is comprised of or coated with an antistatic; and in that at least a part of the target electrode surface is formed by parts (37, 137; 21, 121) of the inside of the housing, wherein those parts which form the target electrode surface and the first group of electrode elements (32, 33; 132, 133) of the capacitor separator (30, 130) are interconnected electrically through the medium of this material.

27. An electrostatic filter according to claim 25, wherein the opposite edges of the first group of electrode elements (32, 33; 132, 133) of the capacitor separator (30, 130) abut directly with the inner surface of the housing (20, 120) and are interconnected electrically through said inner surface; and wherein the second group of electrode elements (33, 133) of the capacitor separator are held spaced from neighbouring electrode elements (32, 132) by intermediate insulators.

28. An electrostatic filter according to claim 25, wherein the non-metallic material is a cellulose fibre material.

29. An electrostatic filter according to claim 25, wherein the non-metallic material is paperboard.

30. An electrostatic filter according to claim 25, wherein the non-metallic material is kraft paper.

31. An electrostatic filter according to claim 25, wherein at least part of the outside and inside of the housing (20, 120) is comprised of or coated with a semi-conductive material.

32. An electrostatic filter according to claim 1, wherein the electrode elements (32, 33; 132, 133) are formed from a semi-conductive material.

33. An electrostatic filter according to claim 1, wherein the electrode elements (33, 133) in the second group of electrode elements of said capacitor separator (30, 130) are provided with field strength concentrating formations.

34. An electrostatic filter according to claim 1, wherein a second ionization chamber (140) includes a second wire corona electrode (141) and a target electrode (142) which is spaced from the second wire corona electrode and which is electrically connected with the second group of electrode elements (133) of the capacitor separator (130), said electrode elements being insulated electrically from one another and disposed at a greater distance from the wire corona electrode (131) of the first ionization chamber (129) than the first group of electrode elements (132).

35. An electrostatic filter according to claim 34, wherein the second ionization chamber is disposed at or in the downstream end of the throughflow passage.

36. An electrostatic filter according to claims 1, wherein the electrode elements (32, 33; 132, 133) of the capacitor separator (30, 130) are essentially planar and plate-shaped and arranged in a stack, the corona electrode (31) extend generally at right angles to the planes of the electrode elements.

37. An electrostatic filter according to claim 1, wherein the high voltage source includes very high-ohmic current limiting resistors in the current circuit connected to the corona electrode.

38. An electrostatic filter according to claim 1, wherein air is transported through the filter with the aid of a fan rotor (15) which is driven by a multi-pole permanently magnetized synchronous motor; and in that a sliding clutch is provided between the fan rotor and the motor to enable the motor to start automatically.

39. An electrostatic filter according to claim 1, wherein the electrode elements (32, 33; 132, 133) are comprised of a high-resistive.

40. A two-stage electrostatic filter comprising an ionization section which is disposed in an upstream part of a throughflow passage and includes an ionization chamber in which there is mounted at least one elongated wire corona electrode which is connected to one pole of the electrical high voltage source, and a target electrode which is spaced from the corona electrode and connected to another pole of the high voltage source, a capacitor separator which is located in a downstream part of the throughflow passage and includes a first group and a second group of electrode elements which are arranged side-by-side in spaced-apart relationship, the electrode elements of the first group being disposed alternatively with the electrode elements of said second group and are on a different potential than the electrode elements of said second group, wherein, the electrode elements (32, 33; 132, 133) comprise a dissipative material having a surface resistivity of $10^9$–$10^{15}$ ohms, the ionization chamber (29, 129) includes a target electrode surface (37, 137; 21, 121; 132, 133) which is disposed both upstream and downstream of the corona electrode (31, 131); a distance of the corona electrode (31, 131) from the target electrode surface, when measured perpendicularly to the upstream and downstream direction of the throughflow passage (28, 128) and the longitudinal direction of the corona electrode being not less than about 4 cm and at least four times the distance between neighbouring electrode elements (32, 33; 132, 133).

41. An electrostatic filter according to claim 40, wherein the dissipative material is on a coating of the electrode element.

* * * * *